United States Patent [19]

Morcov

[11] 4,165,615

[45] Aug. 28, 1979

[54] PRESSURE REGENERATOR FOR INCREASING OF STEAM, GAS, OR HOT AIR PRESSURE AND ROTATING STEAM BOILER, WITH ADDITIONAL EQUIPMENT

[76] Inventor: Paune Morcov, No. 12, Georg Büchner Weg, 6050 Offenbach am Main, Fed. Rep. of Germany

[21] Appl. No.: 781,270

[22] Filed: Mar. 25, 1977

[30] Foreign Application Priority Data

Mar. 30, 1976 [DE] Fed. Rep. of Germany ..... 2613418

[51] Int. Cl.[2] ..... F01K 19/10

[52] U.S. Cl. ..... 60/685; 60/690; 122/11; 60/669

[58] Field of Search ..... 60/669, 653, 670, 685, 60/690, 694; 165/86; 122/11

[56] References Cited

U.S. PATENT DOCUMENTS 3,613,368 10/1971 Doerner ..... 60/669 X

*Primary Examiner*—Allen M. Ostrager

*Attorney, Agent, or Firm*—John C. Smith, Jr.

[57] ABSTRACT

Apparatus for reheating the exhaust steam or other working fluid from an external combustion engine, e.g., a turbine, comprises two contra-rotating drums, each containing conduit means arranged in a spiral through which the exhaust fluid flows in succession, the drums being located in a cylindrical housing which is divided into four quadrants through which the drums rotate, two of the quadrants being supplied with heat from an external source, one quadrant being neutral and one quadrant being cooled.

12 Claims, 12 Drawing Figures

Fig. 5
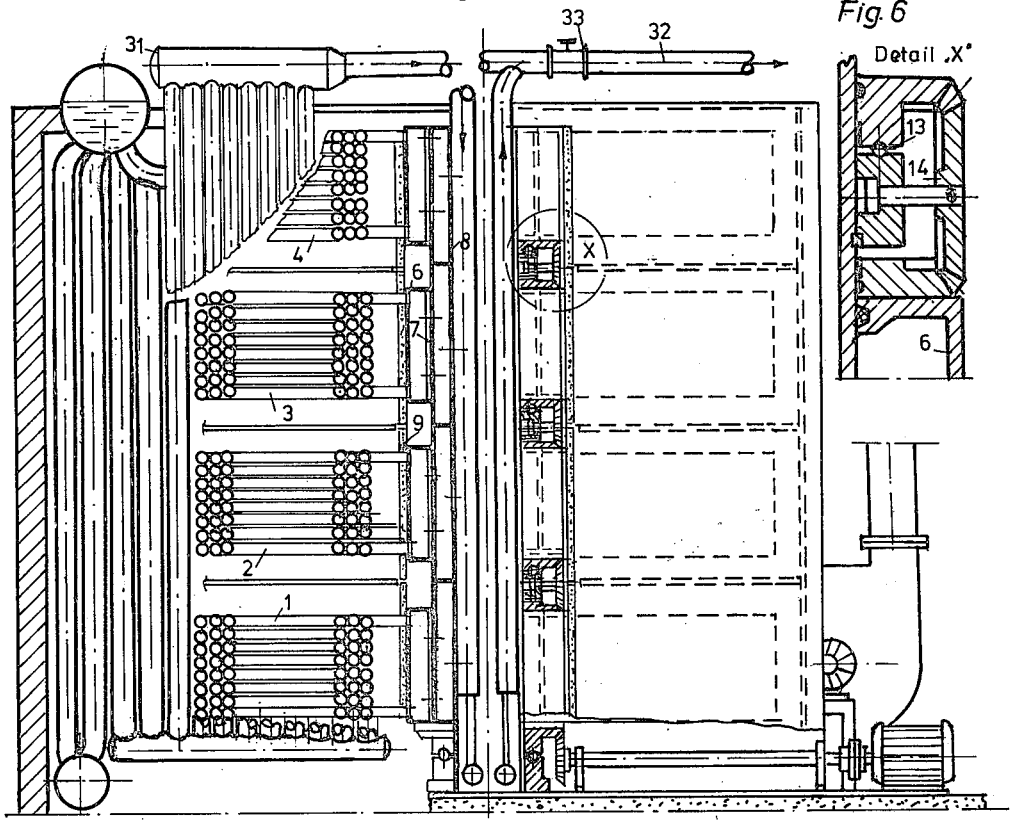
Fig. 6
Fig. 7
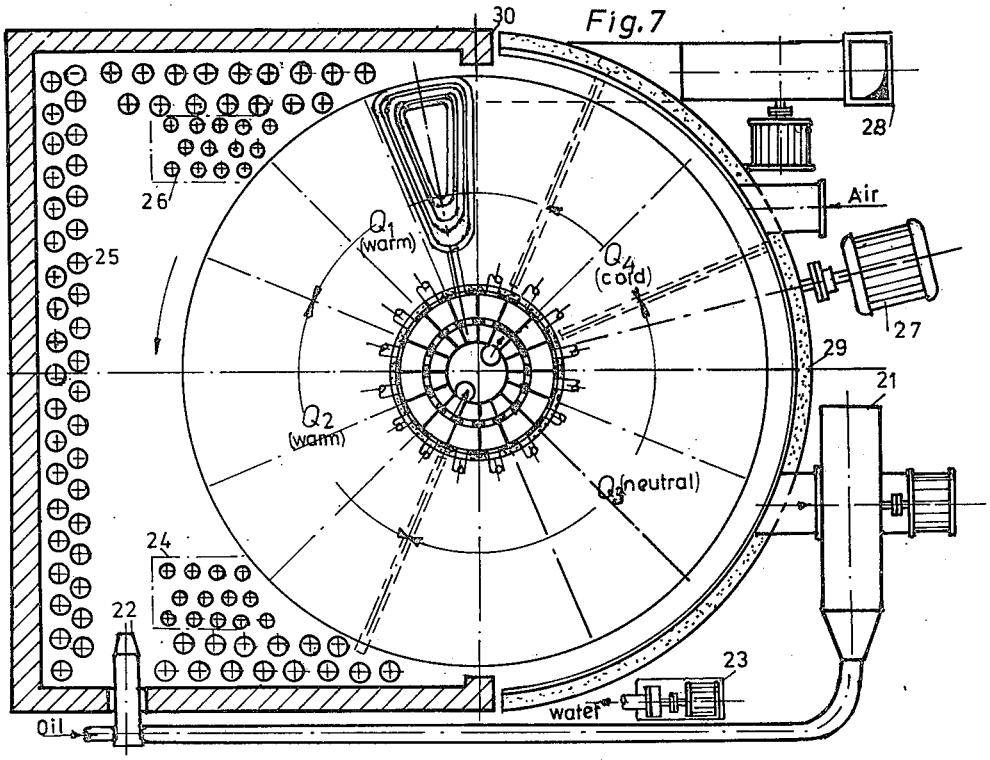

Detail „X"

Section A-A

Entry
Rotarysens Drum 1
Delivery
Drum 1
Drum 2
Quadr. 1 + 2
Quadr. 3
Quadr. 4
2,46-0,27=2,19 Kg
0,39 Kg
°C
°K

PRESSURE REGENERATOR FOR INCREASING OF STEAM, GAS, OR HOT AIR PRESSURE AND ROTATING STEAM BOILER, WITH ADDITIONAL EQUIPMENT

BACKGROUND OF THE INVENTION

This invention relates to apparatus for reheating the exhaust steam or other working fluid from an external combustion engine, e.g., a turbine.

One of the most important uses of the apparatus is that of a steam regenerator in power stations where it receives exhaust steam from the turbine and takes over some or all of the functions of the stationary boiler.

In a nuclear power station the apparatus may be used as a steam superheater thus increasing the thermal efficiency.

The conventional condensers are eliminated by the present invention. A vacuum (0.04 atm.) in the condenser of a conventional steam plant allows a further expansion in the exhaust stage of the turbine which contributes to increasing the latter's efficiency. Since the condenser, however, requires a lot of water (60–100 times as much as steam) the construction of a power station mainly depends on the water supply.

The solution of this problem has become more and more difficult especially with respect to nuclear power stations as the events of recent days have taught us.

The condensing-turbine works nowadays with a degree of efficiency of its own of 70–72%, whereas its total degree of efficiency, however, may decrease to 35–40% according to the technological design governing the utility of heat. In other words, the total efficiency of a power station operating with steam turbines depends on the thermal fall or, in our case, of the steam enthalpy being 400–500 Kcal/Kg for condensing-turbines with great efficiency and 150–250 Kcal/Kg for counter-pressure turbines, whereas the total enthalpy of fresh steam amounts to 700–860 Kcal/Kg (for 600° C. and 200 atm.). So we can observe an enormous loss of heat in such stations and as a consequence, only 30% of the fuel energy which is supplied is transformed into mechanical work.

For years the phenomenon of condensation has supported the conviction that heat from steam evaporation can be obtained by means of the condenser. Nevertheless, it is a well known fact that 60% of the total steam heat is taken away by the cooling medium, plus 5% other heat losses.

A temperature fall takes place in the condenser, but the vacuum is the only effect of condensation and it is paralleled by the decrease in enthalpy and is advantageous. Some authors give the following results: 1% vacuum (more than 90%) corresponds to 1% of fresh steam. But they all agree upon the statement that for thermodynamic reasons the condenser requires an enormous supply of energy. According to the Mollier h-s diagram the decrease in enthalpy can maximally amount to 210 Kcal/Kg for steam under a pressure of 1 atm. (97% vacuum). Consequently 329.4 Kcal/Kg are lost. The same applies to the counter-pressure turbine in which after having passed the turbine the steam is reutilized and transformed into water by condensation—a natural phenomenon—but this transformation results in the evaporation heat being lost (at a minimum 539.4 Kcal/Kg with 1 atm. and 100° C.). In order to avoid such an important loss of heat, the enthalpy of the steam must be increased again after having passed the last stage of the turbine to avoid being a quantity of steam transformed into water. Consequently, the condenser must be substituted by a new device.

The apparatus of the present invention can be used as a steam supply for an energy producing plant irrespective of whether it is stationary or mobile (locomotives, vessels or other vehicles). In chemical plants there are processes which require very high pressures and temperatures, and in this field of application the compressors and fans presently used can be successfully replaced by a regenerator in accordance with the present invention. In metallurgy the present invention can be used as a hot-air compressor, as for example, for a blast furnace; or it can replace axial compressors in power stations operating with gas turbines.

SUMMARY OF THE INVENTION

The pressure regenerator of the present invention comprises two contra-rotating drums each containing conduit means arranged in a spiral through which the exhaust fluid flows in succession. The drums are located in a cylindrical housing which is divided into four quadrants through which the drums rotate in opposite directions. Two of the quadrants are supplied with heat (180°), one quadrant (135°) is neutral, and the last quadrant (45°) is cooled, During rotation of the drums the exhaust steam is heated (150° C. to 520° C.), and consequently the pressure increases from 5 atm. to 36.5 atm. At a discharge point (after 180°), a predetermined quantity of steam is delivered as fresh steam back to the turbine. In the third quadrant the "rest-pressure" (5 atm.) will be uniformly delivered to the sections in the first and second quadrants. Thus, the pressure increased due to the temperature rise and the admission of steam. In the fourth quadrant (45°-cooled) the steam pressure is reduced to a minimum value (1–3 atm.) thus allowing the sections to be recharged in the first quadrant.

The apparatus of the present invention may be used as a pressure regenerator, heated with combustion gases or with an appropriate burning unit or as a rotating steam boiler as a substitute for a stationary boiler.

BRIEF DESCRIPTION OF THE DRAWINGS

The pressure regenerator will now be described in detail with reference to the accompanying drawings wherein:

FIG. 5 is a partial sectional elevation of the rotating steam boiler with four drums;

FIG. 6 is an enlarged view of detail "X" concerned with actuation between the drums;

FIG. 7 is a plan view of the apparatus shown in FIG. 5;

DESCRIPTION OF THE PREFERRED EMBODIMENT

Figure 1:
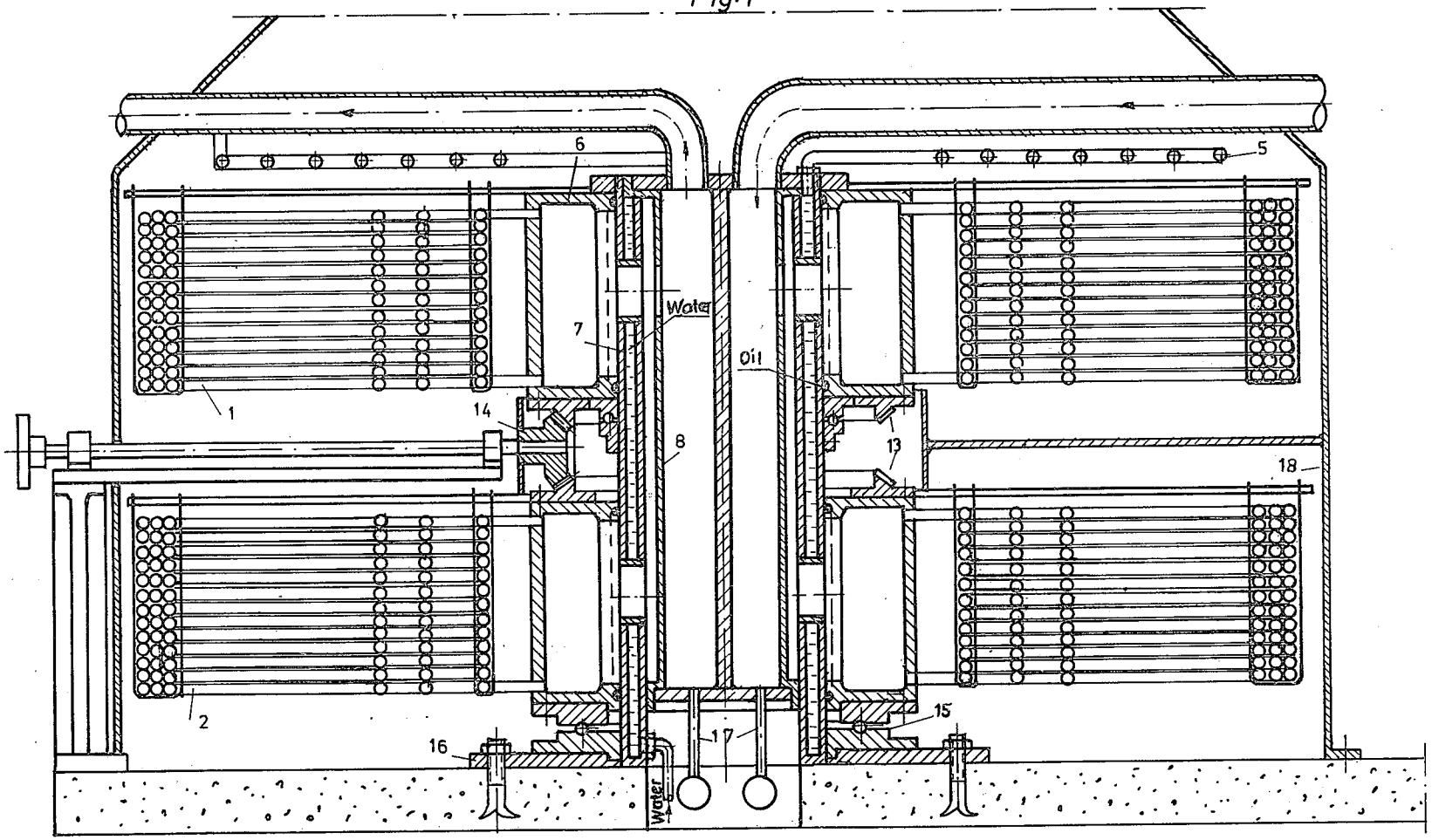
FIG. 1 is a vertical sectional view of the apparatus according to the invention.
Figure 2:
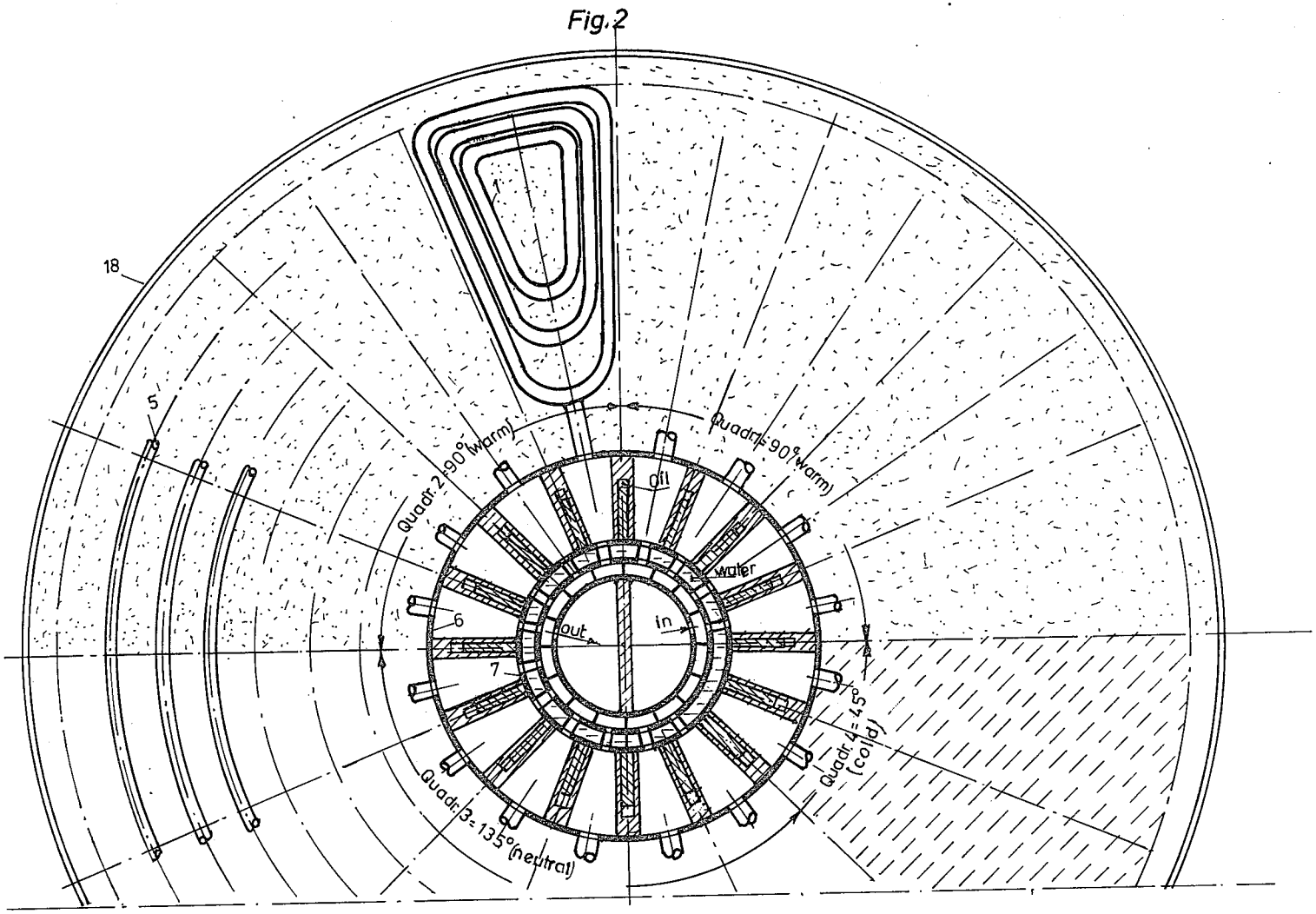
FIG. 2 is a partial plan view of the apparatus of FIG. 1.
Figure 3:
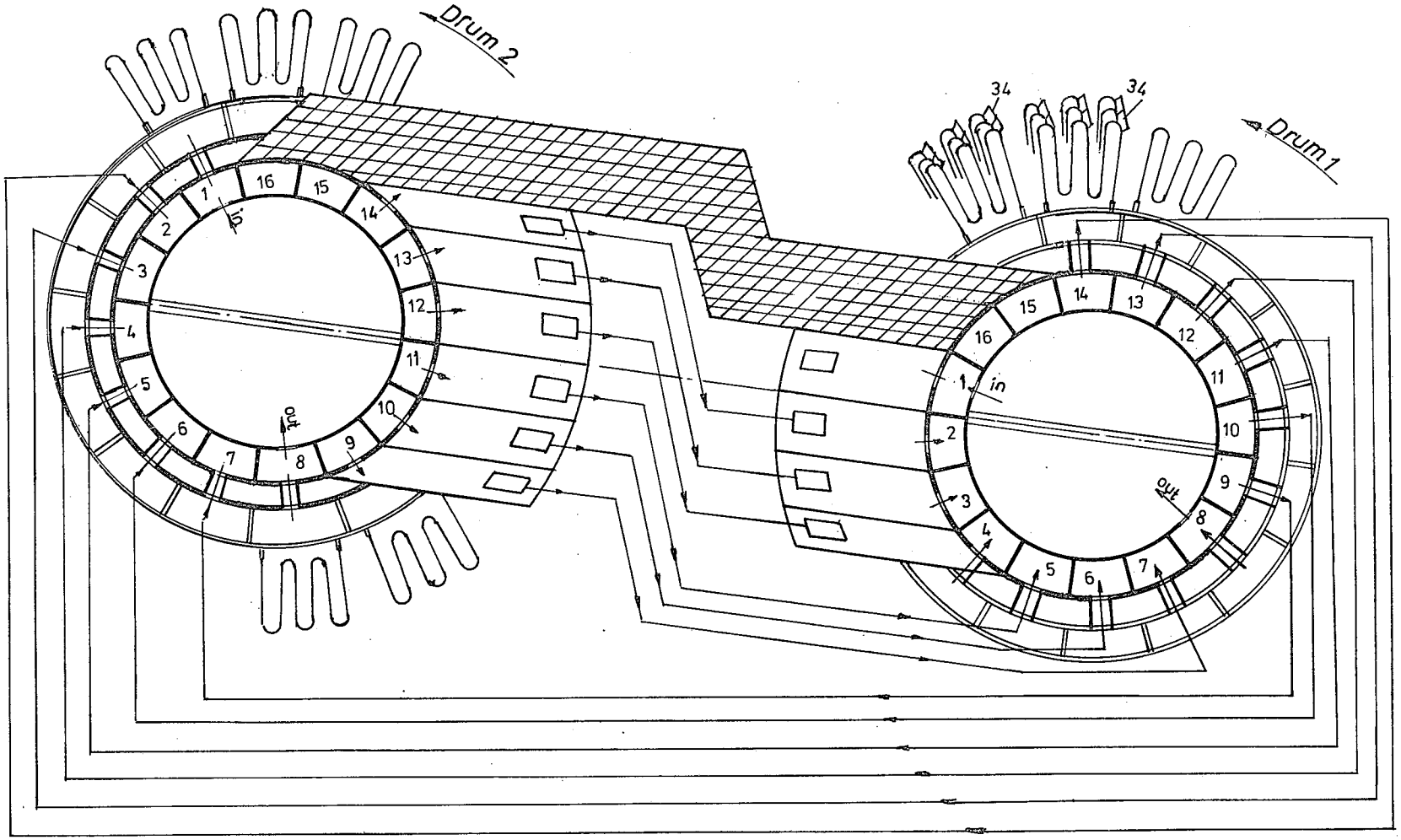
FIG. 3 diagrammatically shows the flow of steam between two rotating drums.

As shown in FIGS. 1–3 a pressure regenerator comprises two drums 1, 2, one of which is situated below the other, revolving in opposite directions and subdivided into sixteen sections. These sections consist of "spiral pipes" which are mounted on an inner ring 6. The interior of the casing 18 enclosing the drums is subdivided into four quadrants. As the drums rotate, each section passes through two quadrants (180°) of hot space whereas the third quadrant is neutral space (135°) and the last, the fourth quadrant (45°), is cooled by fresh air. The inner ring also is subdivided into sixteen cells and surrounds an inner pipe 7 enclosing a water cooling jacket. The water flows upwardly to where the inner pipe 7 is connected with the spiral pipe 5. In this spiral pipe is the steam produced (about 10%) in order to compensate the loss of steam in a turbine connected to the regenerator. After a section has been filled with exhaust steam through a supply pipe the steam pressure is raised in the first and second quadrants during the rotation of the drum.

Figure 12:
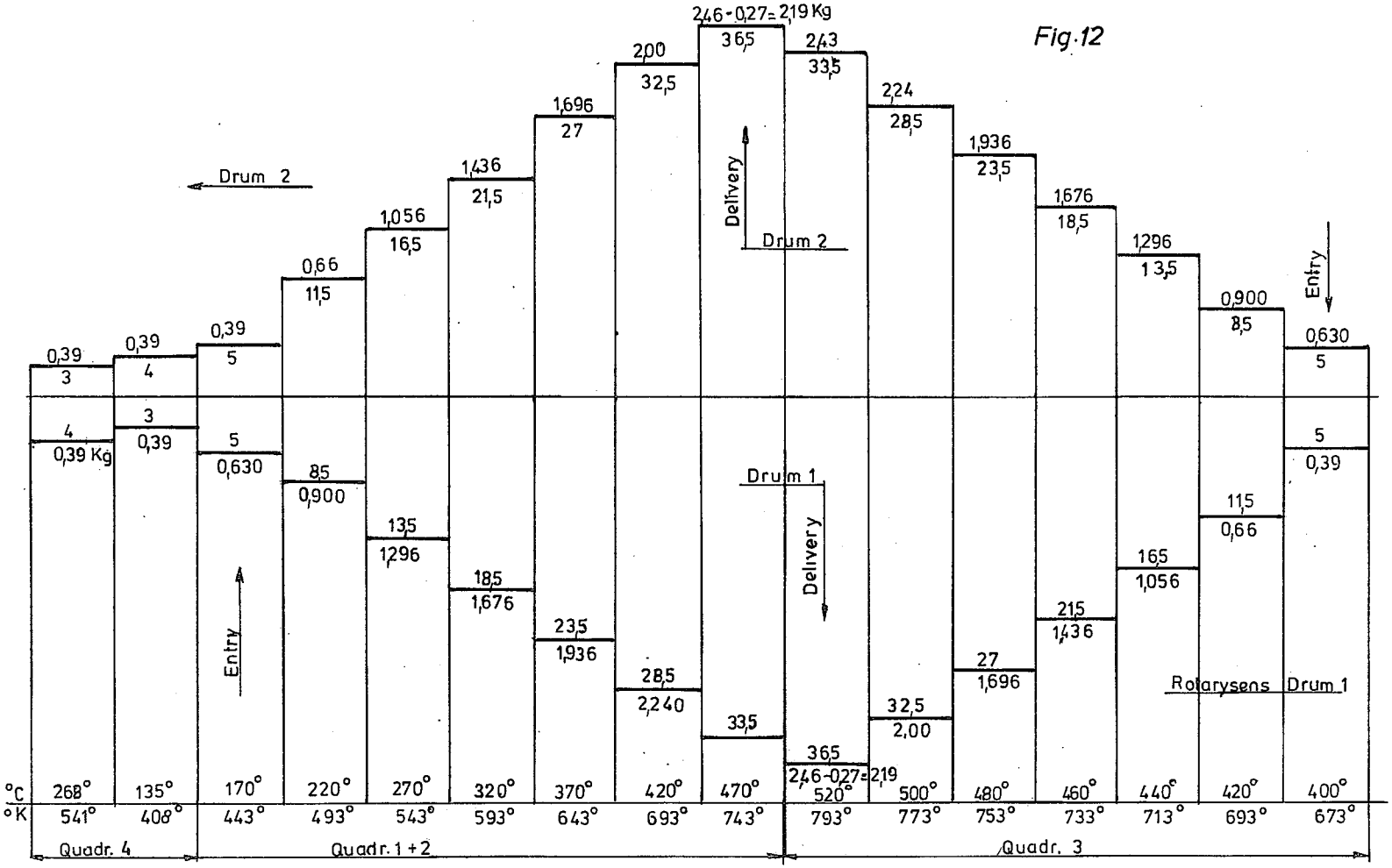
FIG. 12 is a diagrammatic illustration of Table No. 1 showing the increase and decrease of pressures for both drums (above the line), the increase and decrease of the weight (below the line), and the temperature variation (below the line) for each section of the drum.

At a discharging point (after 180°) a certain quantity of steam (here: G=0.24 kg) is discharging from the section. The charging and discharging points are indicated in FIG. 2. The sections are discharged in the third quadrant and the steam passes from the first drum 2 to the second drum through channels between pipe 7 and pipe 8. This process which causes raising and reducing the steam pressure is illustrated in FIGS. 3 and 12 which diagrammatically illustrate Table No. 1 hereinafter. Whereas in the first and second quadrants the sections are charged with steam, the opposite process takes place in the third quadrant where the cells are partially discharged. Since the heat only "walks" from one drum to the other, this "ballast" cannot be considered as a thermal disadvantage. It is obvious that as a result of this the dimension of the drum must increase, since this is the only feasible way to raise the steam pressure.

In the fourth quadrant the pressure decreases as a result of the cooling (in our example to 3 atm.) thus allowing the sections to be recharged in the first quadrant.

According to the increase of steam speed in the cells the heat transition coefficient is increasing too. Therefore in certain cases (extremely loaded units) it is advisable to provide the different parts of the sections with a "bypass" 34 (FIG. 3). The inner pipe 8 is attached to a base plate 16 and serves as a steam supply line and a support for the two drums. A ball bearing 15 and condensation water pipes are situated at the lower end.

Figure 9:
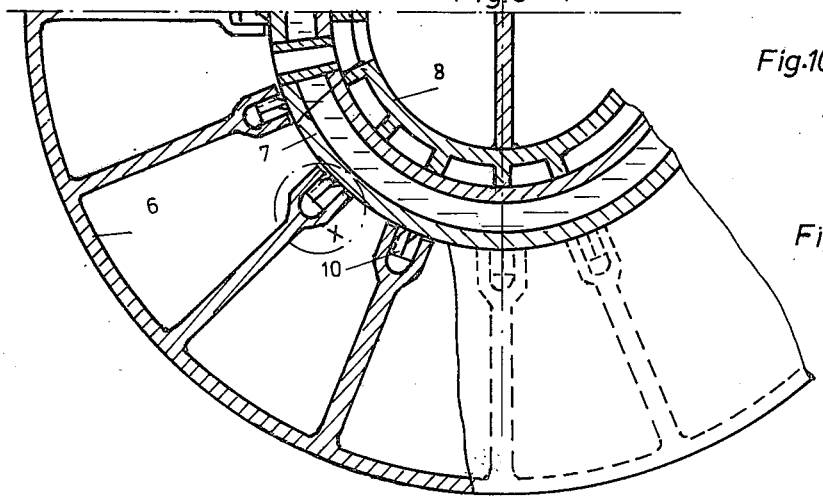
FIG. 9 is a partial plan view of the arrangement shown in FIG. 8.
Figure 10:
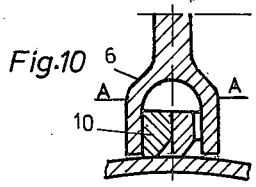
FIG. 10 is an enlarged view of detail "X" in FIG. 9.
Figure 11:
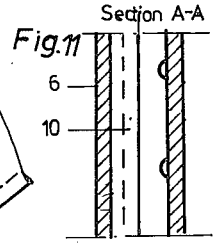
FIG. 11 is a sectional view taken along the line A—A in FIG. 10.

The two drums are driven by an electric motor 27 (FIG. 7) through pairs of gear rings 14 (FIGS. 5 and 6). A packing placed between the ring and the pipe consists of a pair of plates 10 (FIGS. 9–11), which are pressed against the pipe by oil pressure fed by a pump 11 and through a cooler 12.

The drums form a "battery" with one common function of raising the steam pressure. Two batteries may be coupled in series as shown in FIG. 5 thus avoiding an increase in the drum diameter. By using the pressure regenerator in place of the condenser, the importance of the stationary boiler can be very much reduced, since only the latter is responsible for the steam losses (10–15%).

If a power station is profiled for the production of electric current, it is more advantageous to replace the stationary boiler by a device according to the invention so all additional equipment, e.g. water supply, burning unit, can be reduced.

FIG. 5 shows a very simple compact plant including the following units:

- four drums (1–4) operating as a rotating steam boiler,
- a fresh-air fan with air-preheater 21,
- a burner unit 22,
- a water supply (from a pump 23 water enters the water cooling jacket of the inner pipe 7, subsequently the preheater 24),
- an evaporation pipe 25,
- a superheater 26,
- an electric geared drive motor 27,
- an exhaust stack 28,
- lagged casing 29,
- seals 30.

From the low-pressure superheater 26 the steam passes to an accumulator 31 which is connected with a line 32. When the steam enters the line a great part of its passes to the turbine through a valve 33. When the turbine is working the steam escapes directly into the line 32 and the valve 33 remains partly closed. The cool air which is required to cool the drum is taken in at the fourth quadrant and pumped to the burner, so an air-preheater is replaced by the rotating boiler itself. The drums are driven by a single gear 27, a few satellites 14 and small conical gearwheels 13 are situated between the gearwheels 13 of the drums.

The rotating boiler has the following advantages:

- a greater thermal efficiency.
- a simple and more flexible way of operating,
- a cooling water supply for a condenser becomes superfluous, and for the boiler it can be reduced by 90%,
- it requires little capital and short erection time
- it economizes fuel,
- safety, since a breakdown can only concern 1/32 of the rotating boiler,
- power station, nuclear power station included, can be built anywhere because they become independent of river water.

One example of the invention is based on the following presuppositions:

A pressure regenerator for a counter-pressure turbine of 4,400 HP has the following characteristics:

| | | |
|---|---|---|
| steam consumption | = 8.63 Kg/seg | super heated steam |
| steam pressure | = 33 atm. spec. vol. = 0.09 mc/Kg<br>spec. wt. = 11 Kg/mc | |
| steam temperature | = 400° C. | |
| enthalpy | = 770 Kcal/Kg | |
| steam quantity/sec. | = 7.77 Kg | |
| steam pressure | = 5 atm. spec. vol. = 0.38 mc/Kg | |

-continued

| | | |
|---|---|---|
| | spec. wt. = 0.262 Kg/mc | exhaust steam |
| steam temperature | = 170° C. | |
| enthalpy | = 673 Kcal/Kg | |

The section of the pressure regenerator is supplied with exhaust steam, and after half a turn of the drums the pressure increases from 5 atm. to 36.5 atm., since there is a counter-pressure of 33 atm. at the discharging point.

Increase of enthalpy=770−673=97 Kcal/Kg
The steam loss in the turbine is estimated at 10%,
This example is based on two drums, each of which is provided with sixteen sections and which rotate at 60 rev./min.

The volume of the sections is chosen so that a steam remains in the section at the discharging point after 0.24 Kg of steam have passed to the turbine. According to the diagram (FIG. 12) this remainder=2.190 Kg.

In the fourth quadrant the steam pressure temperature decreases to 3 atm. and 135° C. According to Table 1, the weight per section in this state is G=0.390 Kg of steam. The results of this process are:

| | |
|---|---|
| 0.390 Kg steam | = remainder in the section |
| 0.240 Kg exhaust steam | = from the turbine |
| 1.800 Kg transfer steam | = passing between the two drums |

The section volume is calculated in the following way:

$$V = \frac{G}{\gamma} = \frac{2.43}{11} = 0.24 \text{ mc}$$

According to the state equation the result at the discharging point is:

| | | |
|---|---|---|
| PV = GRT | PV = | 10,330 × 36.5 × 0.24 = 90,500 kgmgrd |
| | GRT = | 2.43 × 47 × 793 = 90,500 kgmgrd |
| Steam consumption/sec. | = | 0.240 Kg - heated exhaust steam |
| | | 0.030 Kg - fresh steam |
| | Total = | 0.270 Kg × 32 sections = 8.64 Kg/sec. |

The drum volume (sixteen sections) is: 0.24×16=3.84 mc. A diameter of 50×4.5 mm is selected for the spiral-pipes which are made of austenitic steel, net profile F=1320 mm².

The total length of a section is:

$$L = \frac{V}{F} = \frac{240 \text{ dcm}^3}{0.132} = 180 \text{ m}$$

for the whole drum: L=180×16=2900 m. The outer surface of a section is: 180×D×3.14=28.3 m². The spiral pipe is curved with a radius of R=2D=2×50=100 mm. Each section consists of three spirals at 60 m. The diameter for a drum per 1 m height of the spiral pipe is:

| | |
|---|---|
| $F = \frac{V}{H} = V =$ | gross volume and is F × H |
| | Gross profile/pipe = 50 × 50 = 2,500 mm² |
| | Against 1,320 mm² (net profile) = an increase of 88%. |

-continued

Also gross volume V = 3.84 × 88% = 7.25 mc and $$F = \frac{7.25}{1} = 7.25 \text{ m}^2 \text{ and}$$

$$\text{Drum Diameter } D = \frac{4 \times 7.25}{3.14} = 3 \text{ m}$$

For rigid construction the spiral pipe is attached to the ring 6 by means of creep resistant steel. All other constructional details are carried out in accordance with DIN (The German Industrial Standard).

By means of flowing exhaust gas with the temperature $t_1$ the heat is imparted by convection to the surface of the spiral pipe with the temperature $t_{w1}$ conducted through the wall with the thermal conductivity λ and the thickness υ and finally—by convection of the opposite wall surface, the temperature of which is $t_{w2}$—into the exhaust steam which originally had a temperature of 170° C.

$$q/\text{section} = \alpha_1 F\cdot(t_1 - t_{w1}) = \lambda/v\cdot F\cdot(t_w 1 - t_{w2})$$
$$\alpha_2\cdot F\cdot(t_{w2} - t_2) \text{ or } q = k\cdot F\cdot(t_1 - t_2)$$

where k=thermal conduction coef.
It is obvious that k is the most important factor. It depends on material, temperature, steam speed, etc.

The heat consumption is calculated as follows:

| | |
|---|---|
| 0.39 Kg steam (135° and 3 atm.) = 770 − 660 Kcal = | 110 × 0.39 = 43 Kcal |
| 0.24 Kg exhaust steam (170° and 5 atm.) = 770 − 673 Kcal = 97 × 0.24 = | 23 Kcal |
| | Total = 66 Kcal |

It is to be noted that the 0.030 Kg fresh steam, which is produced by the pipe 3, does not arise from the regenerator pressure.

In the present case, calculations are based on the following values:

k=60 Kcal/mhgrd
F=28.3 m²/section
$t_1$=560° C. temperature of the combustion gas
$t_2$=280° C. average temperature of the exhaust steam Also q=60×28.3×(560−280)=475,440 Kcal/h per sec.=475,440/3,600=132 Kcal and for ½ sec. =132/2=66 Kcal as already indicated above.

Figure 4:
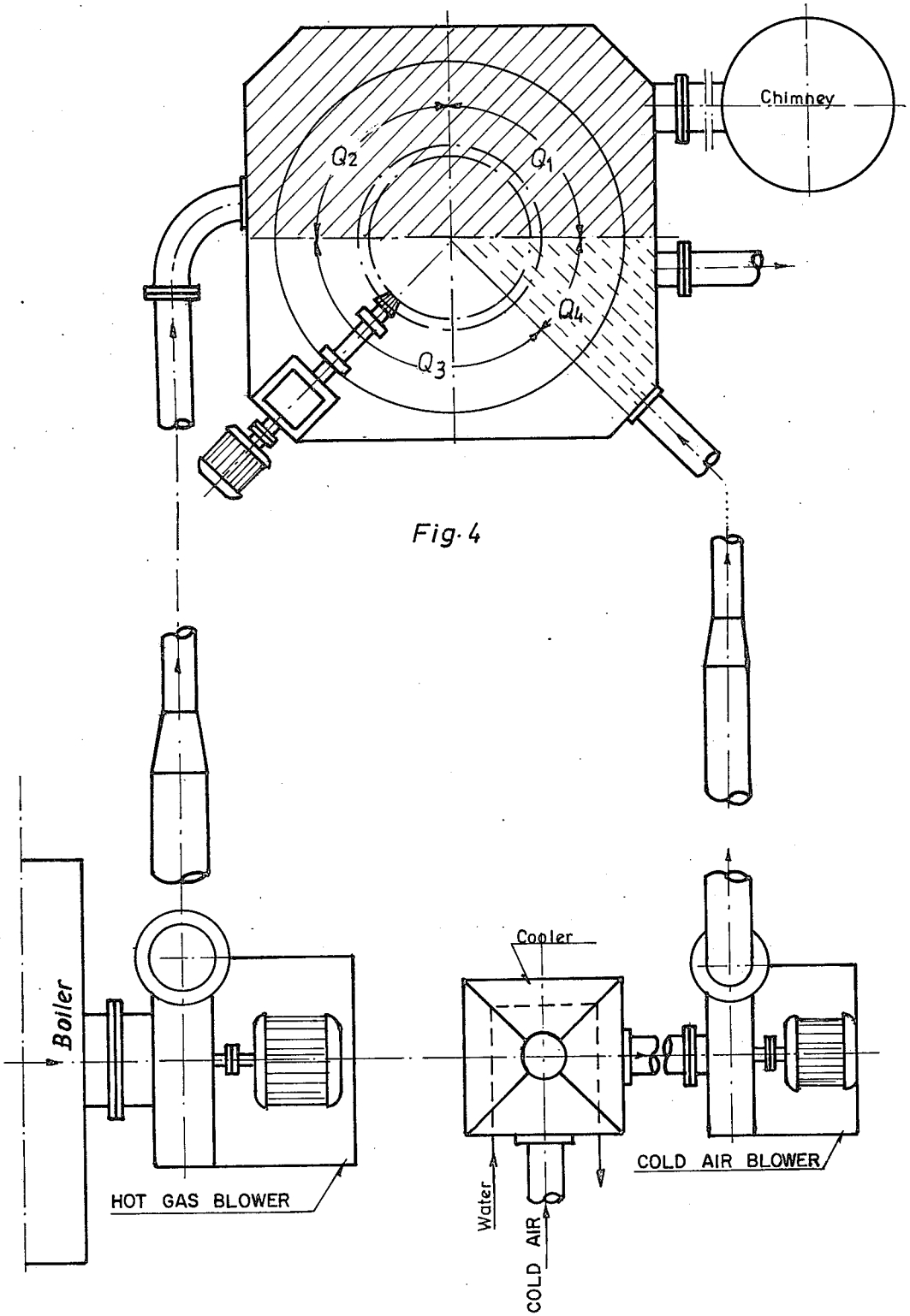
FIG. 4 is a plan view of a plant incorporating the pressure regenerator heated with combustion gases.
Figure 8:
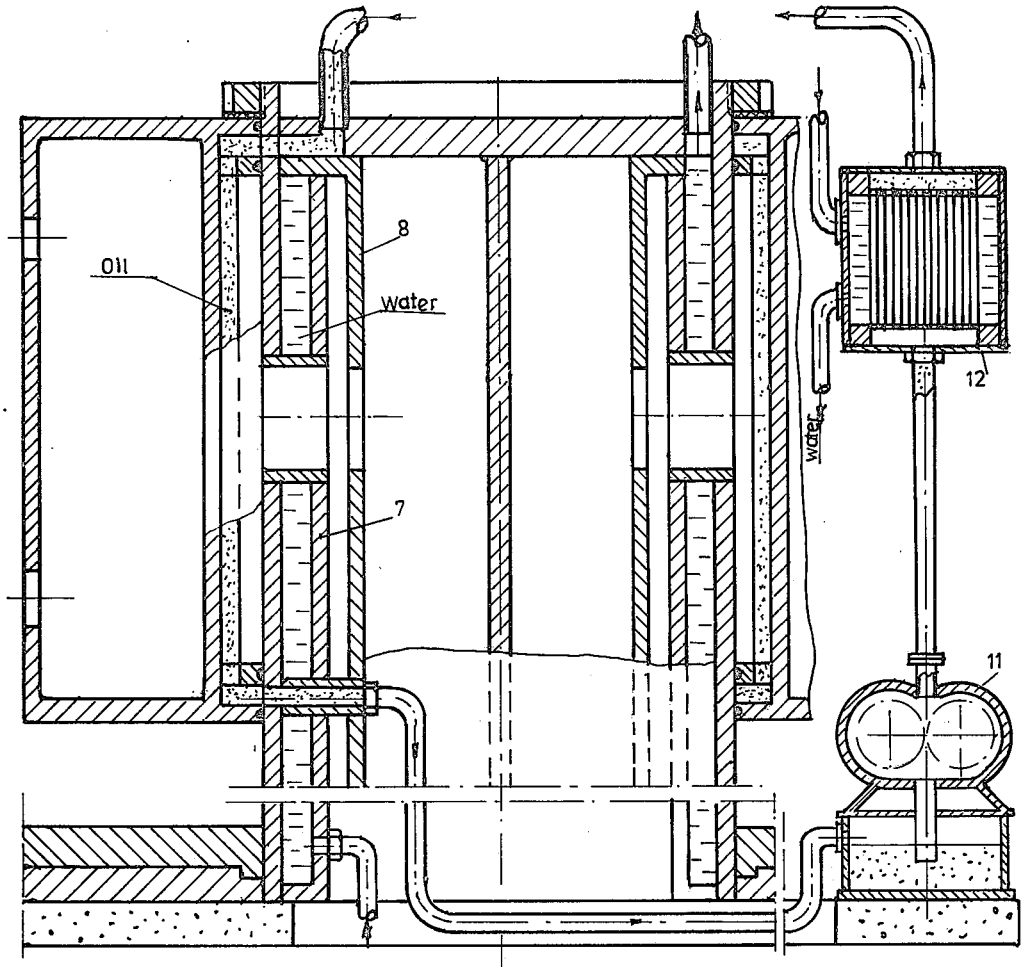
FIG. 8 is a cross-sectional view showing the flow of lubricant and coolant to the apparatus particularly in the principal axis.

It can be seen in the scheme shown in FIG. 4 how the rotating boiler operates in an existing power station. If "radiating bodies" (gas-supplied infrared radiators) are required these bodies can be mounted directly on the casing 18. This device, however, is only used with extremely loaded units. For new plants it is advisable to utilize the rotating steam boiler as a substitute for a conventional boiler.

In the fourth quadrant the drums are cooled by means of fresh air thus reducing the pressure from 5 to 3 atm. and temperature from 400° C. to 135° C. The necessary heat transport is calculated as follows:

$$q = G \cdot c_v (t_2 - t_1) \text{ Kcal} = 0.39 \times 0.28 \times (400 - 135) \text{ Kcal.}$$

$$q \times 0.109 \times 265 = 29 \text{ Kcal/section}$$

The carrying of heat results:

$$q = \frac{\alpha . F. (t_1 - t_2)}{\theta} \qquad \alpha = 40 \text{ Kcal/mhgrd} \quad F = 28.3 \text{ m}^2 \quad \theta = 0.0045 \text{ m}$$

$$t_1 = 400° \text{ C.} \quad t_2 = \frac{20 + 135}{2} = 77.5° \text{ C.}$$

Consequently:

$$q = 40 \times 28.3 \times (400 - 77.5)/0.0045 = 81{,}000{,}000 \text{ Kcal/mhgrd.}$$

$$\text{per one sec. } q = 81{,}000{,}000/3{,}600 = 22{,}500 \text{ Kcal/sec.}$$

$$\text{or per } \tfrac{1}{8} \text{ sec. } q = 22{,}500/8 = 2{,}810 \text{ Kcal/section} > 29 \text{ Kcal.}$$

In order to guarantee a perfect functioning of the apparatus, it is provided with measuring and regulating instruments. Expecially the temperature in the quadrants and the steam pressure in the sections must be strictly observed.

The heat balance sheet of the apparatus shows:

supplied heat (after the turbine)/-sec. $= 8.63 \times 770 = 6{,}645$ losses (caused by cooling = decrease in enthalpy) $= 29 \times 32 = 930$ Kcal loss $= 930/6{,}645 = 14\%$ (without quota for actuation $= 1\%$)

A condenser heat balance sheet shows:

supplied heat (after the turbine)/-sec. $= 8.63 \times 770 = 6{,}645$ loss (caused by cool water in the condenser):

$$539.4 - 110 = 329 \text{ Kcal/Kg and } 8.63 \times 429 = 3{,}700.$$

quota for actuation $= 5\%$ (self consumption) $= 5\% \times 6{,}645 = 332$ Kcal $$\text{Total} = 4{,}032 \text{ Kcal}$$

$$\text{Loss} = 4{,}032/6{,}645 = 60.7\%$$

The results show that the heat loss in a condenser can be four times as important as in a pressure regenerator according to the invention. The loss is reduced still further when the regenerator is utilized as a boiler substitute. Generally in a conventional plant (with boiler and condenser) the energy supplied by fuel (100%) is distributed in:

15% losses in the boiler (exhaust gas, lines, convection)
30% mechanical work
7% loss of steam in the turbine
42% carried away by cooling water in the condenser
5% for actuation (self consumption)
1% other losses By utilizing the present invention, the energy supplied by the fuel is distributed in:

8% boiler losses
68% mechanical work
7% steam losses in the turbine
2% for actuation
14% losses caused by cooling the drums
1% other losses So twice as much mechanical work can be produced with the present invention than with a condenser.

What is claimed is:

1. Apparatus for increasing the pressure and temperature of exhaust working fluid from a heat engine, comprising a casing defining two heated zones, a neutral zone and a cooled zone;

at least one pair of contra-rotating drums in said casing arranged such that successive sections of each drum pass in sequence through said zones; and a spirally-coiled pipe in each drum, said pipes being connected such that fluid fed to one drum passes in succession through the pipes of both drums to an outlet from the other drum.

2. Apparatus according to claim 1 including a fuel burner to supply heat to said heated zones.

3. Apparatus according to claim 2 including stationary steam raising pipes within said heated zones to feed steam to said one drum.

4. Apparatus according to claim 1 further comprising means for directing a flow of fresh air to cool said cooled zone.

5. Apparatus according to claim 1 wherein said drums are arranged to rotate about a common vertical axis, said apparatus further comprising an electric motor and gearing to drive said drums.

6. Apparatus according to claim 5 further comprising a hollow support for mounting said drums, inlet and outlet pipes within said hollow support for said drums and a cooling water jacket surrounding said hollow support.

7. Apparatus according to claim 6 wherein said drum sections are sealed and wherein they engage the hollow support by sealing laminae disposed on the wall of said support and by hydraulic pressure of lubricating fluid applied to the surface of said support.

8. Apparatus according to claim 7 further comprising an oil pump and a radiator for supplying said lubricating fluid.

9. Apparatus according to claim 1 further comprising peripheral ring gears meshing in pairs with bevel drive gears for rotatably driving said drums.

10. Apparatus according to claim 1 further comprising a pipe spiral provided above said drums for receiving cooling water from said drums to compensate for vapor losses.

11. Apparatus according to claim 1 wherein said cooling zone serves as a preheater for air supplied to said heated zone.

12. A steam-driven power plant including a turbine and apparatus according to claim 1 connected to said turbine such that the exhaust steam from said turbine is fed into and through said apparatus and returned to the steam inlet of said turbine in a closed cycle.

* * * * *